US011433502B2

(12) United States Patent
Saito et al.

(10) Patent No.: US 11,433,502 B2
(45) Date of Patent: Sep. 6, 2022

(54) POLISHING TABLE AND POLISHING APPARATUS HAVING IHE SAME

(71) Applicant: EBARA CORPORATION, Tokyo (JP)

(72) Inventors: Kenichiro Saito, Tokyo (JP); Ryuichi Kosuge, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 499 days.

(21) Appl. No.: 15/996,988

(22) Filed: Jun. 4, 2018

(65) Prior Publication Data

US 2018/0345447 A1 Dec. 6, 2018

(30) Foreign Application Priority Data

Jun. 6, 2017 (JP) ..... JP2017-111605

(51) Int. Cl.
*B24B 37/22* (2012.01)
*B24D 3/32* (2006.01)
(Continued)

(52) U.S. Cl.
CPC ..... *B24B 37/22* (2013.01); *B24B 37/105* (2013.01); *B24B 37/16* (2013.01); *B24B 37/24* (2013.01);
(Continued)

(58) Field of Classification Search
CPC ..... B24B 37/015; B24B 37/04; B24B 37/12; B24B 37/14; B24B 37/16; B24B 37/22;
(Continued)

(56) References Cited

U.S. PATENT DOCUMENTS 6,599,175 B2 * 7/2003 Herb ..... B24B 37/26 451/446
7,160,181 B2 * 1/2007 Jeung ..... B24B 37/205 451/285
(Continued)

FOREIGN PATENT DOCUMENTS

JP H10-264013 A 10/1998
JP 2002-520174 A 7/2002
(Continued)

OTHER PUBLICATIONS

Machine translation of JP-2014176950-A, Sep. 2014 (Year: 2014).*

*Primary Examiner* — Orlando E Aviles
*Assistant Examiner* — Robert F Neibaur
(74) *Attorney, Agent, or Firm* — Pearne & Gordon LLP

(57) ABSTRACT

An object of the present invention is to provide a polishing table capable of preventing peeling or detachment of a coating of the polishing table, thereby to enable an operation for replacement of a polishing pad to be easily conducted. One embodiment of the present invention provides a polishing table having a support surface configured to support a polishing pad, the polishing pad being adapted to be used for polishing a substrate, the polishing table comprising: a stacked body comprising a stack of a porous layer and a non-porous layer, the porous layer including open pores formed in a surface thereof disposed to face a polishing pad; and a resin-based coating material disposed in the open pores so as to form at least a part of the support surface of the polishing table.

6 Claims, 3 Drawing Sheets

(51) Int. Cl.

| | |
|---|---|
| ***B24B 37/24*** | (2012.01) |
| ***B24B 37/16*** | (2012.01) |
| ***B24B 55/02*** | (2006.01) |
| ***B24B 37/10*** | (2012.01) |
| ***B24B 45/00*** | (2006.01) |
| ***B24B 37/34*** | (2012.01) |
| ***B24B 41/047*** | (2006.01) |
| ***B24B 37/04*** | (2012.01) |

(52) U.S. Cl.
CPC ..... *B24B 55/02* (2013.01); *B24D 3/32* (2013.01); *B24B 37/04* (2013.01); *B24B 37/34* (2013.01); *B24B 41/047* (2013.01); *B24B 45/006* (2013.01)

(58) Field of Classification Search
CPC ..... B24B 37/24; B24B 37/26; B24B 55/02; B24B 41/047; B24D 3/32; B24D 3/001; B24D 3/002; B24D 3/004
USPC ..... 451/41, 53, 287, 285, 449
See application file for complete search history.

(56) References Cited

U.S. PATENT DOCUMENTS

| | | | | |
|---|---|---|---|---|
| 7,497,763 | B2 * | 3/2009 | Bottema | B24B 37/205 451/6 |
| 2002/0111120 | A1 * | 8/2002 | Goetz | B24B 37/22 451/527 |
| 2004/0248508 | A1 * | 12/2004 | Lombardo | B24B 21/04 451/537 |
| 2007/0004324 | A1 | 1/2007 | Hirose et al. | |
| 2011/0281510 | A1 * | 11/2011 | Swedek | B24B 37/26 451/446 |
| 2015/0118944 | A1 | 4/2015 | Kosuge et al. | |
| 2018/0229344 | A1 | 8/2018 | Ueno et al. | |

FOREIGN PATENT DOCUMENTS

| | | | | | |
|---|---|---|---|---|---|
| JP | 2004-148464 | A | | 5/2004 | |
| JP | 2006-188428 | A | | 7/2006 | |
| JP | 2008-238375 | A | | 10/2008 | |
| JP | 2014-176950 | A | | 9/2014 | |
| JP | 2014176950 | A | * | 9/2014 | B24B 37/04 |
| WO | 00-02708 | A1 | | 1/2000 | |
| WO | 2017-038032 | A1 | | 3/2017 | |

* cited by examiner

POLISHING TABLE AND POLISHING APPARATUS HAVING IHE SAME

TECHNICAL FIELD OF THE INVENTION

The present invention relates to a polishing table and a polishing apparatus having the same.

BACKGROUND OF THE INVENTION

In recent years, for polishing a surface of a substrate such as a semiconductor wafer, a polishing apparatus is used, which comprises a polishing table having a support surface configured to support a polishing pad used for polishing a substrate. A surface of a substrate can be polished by pressing the substrate, held by a top ring, on the polishing pad adhered to the support surface of the polishing table, which is rotating.

In a polishing apparatus of this type, a polishing pad is treated as an expendable or replaceable component. Therefore, periodic replacement of a polishing pad is conducted. Generally, replacement of a polishing pad is conducted manually by an operator.

FIG. 4A is a sectional view showing an example of a state of adhesion of a polishing pad 408 and a polishing table 410 in a conventional polishing table 410. As shown in FIG. 4A, the polishing pad 408 has a polishing surface 408*a* on which a substrate to be polished (not shown) is pressed. The polishing pad 408 has a layer of adhesive 409 provided on a rear surface 408*b* on a side opposite to the polishing surface 408*a* of the polishing pad 408. The layer of adhesive 409 is preliminarily provided so as to form an adhesive surface of the polishing pad 408. In an operation for adhering the polishing pad 408 to the polishing table 410, an operator manually adheres the layer of adhesive 409 of the polishing pad 408 to an upper surface 410*a* of the polishing table 410. Thus, the upper surface 410*a* of the polishing table 410 forms a support surface for supporting the polishing pad 408.

For preventing the polishing pad 408 from being displaced during polishing of a substrate, the polishing pad 408 is adhered to the upper surface 410*a* of the polishing table 410 with an adhesive force having a certain degree of strength. Therefore, an operation for detaching the polishing pad 408 from the polishing table 410 for replacement is time-consuming, because it is difficult to peel off the polishing pad 408 from the polishing table 410.

Further, in an operation for adhering or attaching the polishing pad 408 to the polishing table 410, there may be a case in which air becomes trapped between the polishing pad 408 and the polishing table 410. Generation of such an air space is likely adversely to affect a profile of a substrate (in other words, an outer contour of a section of a substrate.) However, the polishing pad 408, which is strongly adhered to the polishing table 410, cannot easily be temporarily peeled off from the polishing table 410 and adhered again to the polishing table 410. Therefore, when an air space is formed between the polishing pad 408 and the polishing table 410, it is required to completely peel off the polishing pad 408 from the polishing table 410 and apply a new polishing pad 408 to the polishing table 410. This is undesirable from the point of economy.

To enable easy detachment of the polishing pad 408 from the polishing table 410, it is proposed to provide a layer of fluorine-based resin or silicone 411 between the upper surface 410*a* of the polishing table 410 and the layer of adhesive 409 of the polishing pad 408. The layer of fluorine based resin or silicone 411 can be adhered to the upper surface 410*a* of the polishing table 410 by coating. The coating is formed to a thickness of about 10∓5 μm. In this case, an upper surface 411*a* of the layer of fluorine-based resin or silicone 411 forms a support surface for supporting the polishing pad 408.

RELATED ART DOCUMENT

Patent Document

Patent document 1: Japanese Patent Public Disclosure No. 2008-238375

Patent document 2: Japanese Patent Public Disclosure No. 2014-176950

As described above, however, the polishing pad 408, which is a consumable component, is required to be replaced periodically. As a result of repetition of an operation for replacement in which the polishing pad 408 is peeled off from the polishing table 410, peeling of the layer of coating 411 of the polishing table 410 occurs. In a portion of the polishing table 410 from which the coating layer 411 is peeled off, a difference in height between the upper surface 411*a* of the coating layer 411 and the upper surface 410*a* of the polishing table 410 is generated. This creates undulation in the polishing surface 408*a* of a new polishing pad 408, which is newly adhered to the polishing table 410. Undulation in the polishing surface 408*a* adversely affects a profile of a substrate, which is pressed on the polishing surface 408*a* during polishing.

To prevent the coating layer 411 from being peeled off from the polishing table 410, a process is carried out whereby the upper surface 410*a* of the polishing table 410 is machined to have a desired surface roughness before it is formed with the coating layer 411. By this measure, a surface area for adhesion between the upper surface 410*a* of the polishing table 410 and the coating layer 411 can be increased. Therefore, due to a so-called anchor effect, detachment of the coating layer 411 when the polishing pad 408 is peeled off from the polishing table 410 can be prevented.

In general, the polishing table 410 is formed from a material having a high hardness, such as silicon carbide. Therefore, it is difficult precisely to machine the upper surface 410*a* of the polishing table 410 to a desired surface roughness. Further, there is a limit to increasing a surface roughness of the upper surface 410*a* of the polishing table 410, because a degree of flatness of the upper surface 410*a* affects a profile of a substrate.

BRIEF SUMMARY OF THE INVENTION

Problem to be Solved by the Invention

According to an embodiment of the present invention, there can be provided a polishing table capable of preventing peeling or detachment of a coating of the polishing table, thereby to enable an operation for replacement of a polishing pad to be easily conducted. Further, according to an embodiment of the present invention, there can be provided a polishing apparatus comprising the above-mentioned polishing table.

Means for Solving the Problem

According to an embodiment of the present invention, there is provided a polishing table having a support surface configured to support a polishing pad, the polishing pad being adapted to be used for polishing a substrate, the polishing table comprising: a stacked body comprising a stack of a porous layer and a non-porous layer, the porous layer including open pores formed in a surface thereof disposed to face a polishing pad; and a resin-based coating material disposed in the open pores so as to form at least a part of the support surface of the polishing table.

DETAILED DESCRIPTION OF THE INVENTION

Figure 1:
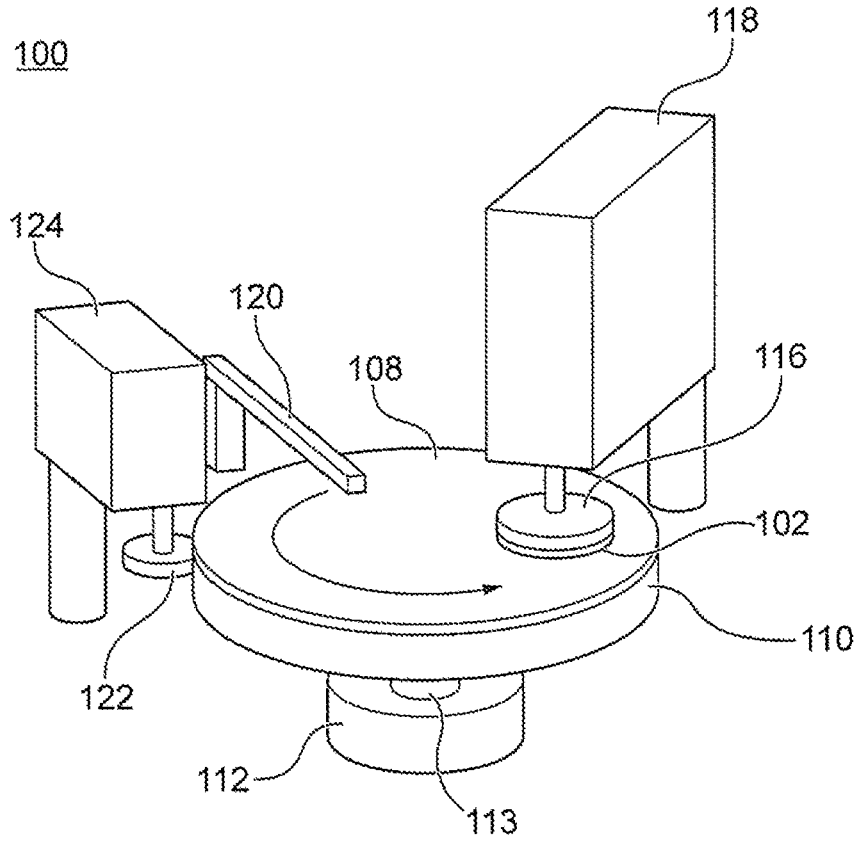
FIG. 1 schematically illustrates an entire configuration of a polishing apparatus according to an embodiment of the present invention.

Hereinbelow, with reference to the drawings, embodiments of the present invention are explained. The following explanation indicates mere examples, and a technical scope of the present invention is not limited to those examples. Further, in the drawings, the same or corresponding elements are designated by the same reference numerals, and any overlapping explanation is omitted. Further, in the following explanation, terms referring to a direction, such as "upper" and "lower," are used with respect to a state in which a polishing table is disposed as shown in FIG. 1. In the embodiments, a CMP (Chemical Mechanical Polishing) apparatus is taken as an example of a polishing apparatus. However, a polishing apparatus according embodiments of the present invention is not limited to a CMP apparatus.

FIG. 1 schematically shows an entire structure of a polishing apparatus according to an embodiment of the present invention. As shown in FIG. 1, a polishing apparatus 100 comprises a polishing table 110 capable of having a polishing pad 108 attached to an upper surface thereof. The polishing pad 108 is used for polishing a substrate 102 such as a semiconductor wafer. The polishing apparatus 100 may further comprise: a first electric motor 112 adapted to drivingly rotate the polishing table 110; a top ring 116 capable of holding a substrate 102; and a second electric motor 118 adapted to drivingly rotate the top ring 116.

The polishing apparatus 100 may further comprise: a slurry line 120 configured to supply a polishing abrasive liquid containing an abrasive material to an upper surface of the polishing pad 108; and a dresser unit 124 having a dresser disk 122 for conditioning of the polishing pad 108.

For polishing a substrate 102, a polishing abrasive liquid containing an abrasive material is supplied from the slurry line 120 to the upper surface of the polishing pad 108, and the polishing table 110 is drivingly rotated by the first electric motor 112. Then, while rotating the top ring 116 about an axis in an eccentric relation to a rotary shaft 113 of the polishing table 110, the substrate 102 held by the top ring 116 is pressed on the polishing pad 108. Thus, the substrate 102 is polished and flattened by the polishing pad 108. As described later, a flow passage is formed within the polishing table 110, to which a cooling liquid for cooling the polishing table 110 is supplied. During polishing, heat generated on the upper surface of the polishing pad 108 and transferred through the polishing table 110 is released to the outside of the polishing apparatus 100 by means of the cooling liquid flowing through the flow passage. A supply passage and a discharge passage for the cooling liquid, communicated with the flow passage within the polishing table 110, are formed within the rotary shaft 113 of the polishing table 110.

Figure 2:
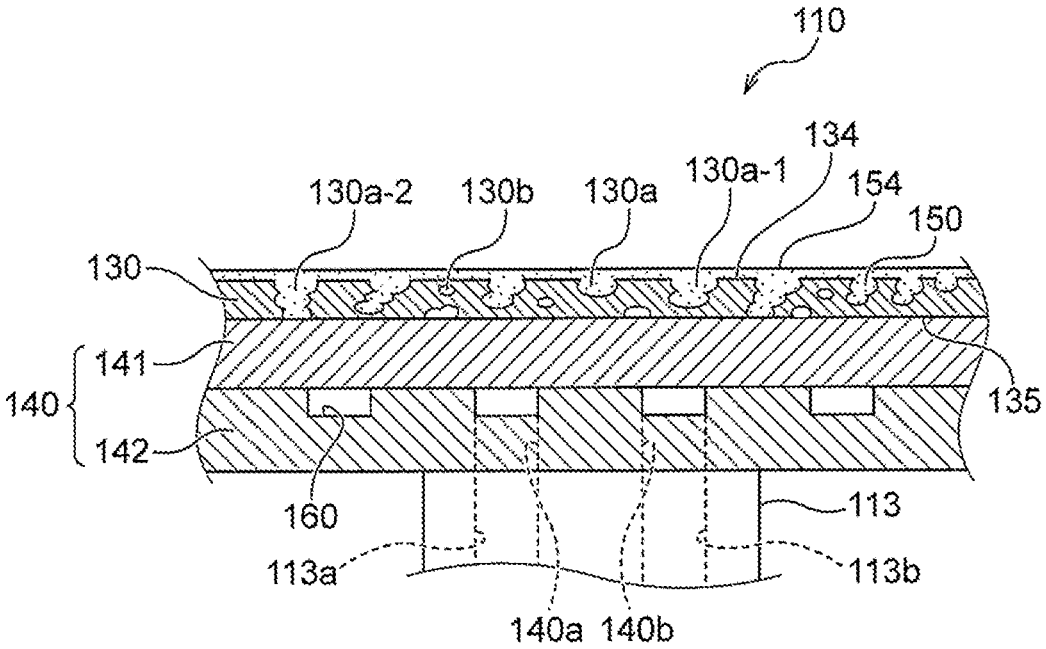
FIG. 2 schematically illustrates a section of a polishing table according to an embodiment of the present invention.

FIG. 2 is a sectional view of a part of the polishing table 110, which shows an essential part of the present embodiment. For ease of understanding, the polishing pad 108 shown in FIG. 1 is omitted in FIG. 2.

The polishing table 110 shown in FIG. 2 comprises a stacked body comprising a stack of a porous layer 130 and a non-porous layer 140. The porous layer 130 forms an upper layer of the polishing table 110. The non-porous (or dense) layer 140 is connected to a lower surface of the porous layer 130 so as to form a lower layer of the polishing table 110. In FIG. 2, by way of an example, the non-porous layer 140 is provided in the form of a stacked body comprising a stack of two non-porous layers; namely, a first non-porous layer 141 and a second non-porous layer 142 connected to a lower surface of the first non-porous layer 141. However, the non-porous layer 140 may comprise a single layer or may comprise a plurality of layers connected to each other. The number of layers constituting the non-porous layer 140 is not particularly limited. Similarly, the porous layer 130 may comprise a plurality of layers.

In the present embodiment, the non-porous layer 140 may comprise various known materials that are used as a material of a polishing table of a conventional polishing apparatus. For example, the non-porous layer 140 may comprise at least one of silicon carbide (SiC,) stainless steel (SUS,) a resin, and aluminum oxide (alumina.)

In the present embodiment, the porous layer 130 may comprise a ceramic material and/or a metal material. An example of a ceramic material includes silicon carbide (SiC). An example of a metal material includes aluminum oxide (alumina.) These materials can be formed into porous bodies by known techniques.

In the present embodiment, a porosity of the porous layer 130 may be from about 50% to about 80%, by way of example. The porosity of the porous layer 130 can be determined from a ratio of a density of the porous layer 130, calculated from the dimensions and weight of the porous layer 130, to a theoretical density of a material constituting the porous layer 130. For example, if a material constituting the porous layer 130 is silicon carbide, of which a theoretical density is 3.2 g/cm3, a porosity of the porous layer 130 can be determined in accordance with the following formula:

$$\text{Porosity (\%)}=(1-(\text{a density of the porous layer130})\div 3.2)\times 100$$

In the present embodiment, the porous layer 130 includes open pores 130*a* formed so as to be open at an upper surface 134 (in other words, a surface disposed to face a polishing pad 108) of the porous layer 130. In the present specification, the term "open pore" means a pore that is open at a surface of the porous layer 130. An open pore may be formed by interconnected pores (such as 130*a*−1 in FIG. 2), or a through pore connecting the upper surface 134 and a side surface and/or a lower surface 135 of the porous layer 130 (such as 130*a*−2 in FIG. 2.) An open pore 130*a* is differentiated from a closed pore 130*b*, which is completely surrounded by the material of the porous layer 130.

In the present embodiment, the porous layer 130 is impregnated with a resin-based coating (or paint) material 150. As the resin-based coating material 150, a fluorine-based resin or a silicone resin may be used, by way of example.

A method for impregnation is not particularly limited. In the example of FIG. 2, the resin-based coating material 150 is applied to the upper surface 134 of the porous layer 130 by coating. The resin-based coating material 150 coated on the upper surface 134 of the porous layer 130 enters the open pores 130*a* formed in the upper surface 134. Coating may be conducted by various methods, such as brushing, rolling, blowing, spraying, etc. The resin-based coating material 150 may be subjected to heat treatment after impregnation. For example, when a silicone resin is used as the resin-based coating material 150, the polishing table 110 and the silicone resin together may be heated to a range of from about 150° C. to about 200° C. When a fluorine-based resin is used as the resin-based coating material 150, the polishing table 110 and the fluorine-based resin together may be heated to a range of from about 300° C. to about 400° C.

The impregnation of the porous layer 130 with the resin-based coating material 150 may be conducted before or after the porous layer 130 and the non-porous layer 140 are connected to each other.

By impregnating the porous layer 130 with the resin-based coating material 150, the open pores 130*a* of the porous layer 130 may be filled with the resin-based coating material 150 as shown in FIG. 2. In the present embodiment, the resin-based coating material 150 is coated on the entire upper surface 134 of the porous layer 130. Therefore, the resin-based coating material 150 is disposed not only in the open pores 130*a*, but also on the upper surface 134 outside the open pores 130*a*. As a consequence, in the polishing table 110 in the present embodiment, an upper surface 154 of the coating of the resin-based coating material 150 forms a support surface for supporting a polishing pad 108.

In the example of FIG. 2, each open pore 130*a* that is open at the upper surface 134 of the porous layer 130 is completely filled with the resin-based coating material 150. In other words, the resin-based coating material 150 reaches the deepest point in each open pore 130*a* in a thickness direction of the porous layer 130. However, this does not limit the present embodiment. The resin-based coating material 150 may occupy only an upper part of the open pore 130*a* so that a substantially flat support surface for supporting a polishing pad 108 can be formed. In other words, in the present embodiment, at least an upper part of the porous layer 130 including the upper surface 134 should be impregnated with the resin-based coating material 150. The porous layer 130 is not necessarily impregnated with the resin-based coating material 150 in its entirety.

A depth of impregnation at which the resin-based coating material 150 fills the open pores 130*a* (in other words, a distance between a level of the upper surface 134 of the porous layer 130 and the deepest point that the resin-based coating material 150 reaches in a thickness direction of the porous layer 130) may be set to, for example, about 0.1 mm to about 0.2 mm. A thickness of the porous layer 130 may be about 5 mm, for example, when a thickness of the polishing table 110 is about 10 mm.

As explained above, according to the present embodiment, the upper surface 154 of the resin-based coating material 150 covering the entire upper surface 134 of the porous layer 130 forms a support surface of the polishing table 110 for supporting a polishing pad 108. The resin-based coating material 150 covers the upper surface 134 of the porous layer 130, while filling the open pores 130*a* formed in the upper surface 134, adhering to a surface of the porous layer 130 within the open pores 130*a*. Therefore, a surface area for adhesion between the porous layer 130 and the resin-based coating material 150 can be increased. Therefore, due to a so-called anchor effect, it is possible to prevent the resin-based coating material 150 from being detached from the porous layer 130 when the polishing pad 108 is peeled off from the polishing table 110. Accordingly, differently from conventional techniques, there is no need to machine a hard surface of a polishing table to a desired surface roughness. Further, as compared to machining, there is no risk of significantly lowering a flatness of a support surface of a polishing table for the purpose of increasing a surface area for adhesion.

As described above, in the present embodiment, a channel 160 forming a flow passage for supply of a cooling liquid for cooling the polishing table 110 is formed in a predetermined pattern within the non-porous layer 140 of the polishing table 110. In FIG. 2, a cooling liquid supply passage 113*a* and a cooling liquid discharge passage 113*b*, formed within the rotary shaft 113 so as to communicate with the channel 160, are also shown. The supply passage 113*a* and the discharge passage 113*b* are communicated with the channel 160 through a through passage 140*a* and a through passage 140*b* formed in the non-porous layer 140, respectively.

In the example of FIG. 2, the channel 160 is formed in an upper surface of the second non-porous layer 142. The second non-porous layer 142 is connected with the porous layer 130 with the first non-porous layer 141 being provided therebetween. Therefore, the channel 160 is located at a position remote from a connection between the porous layer 130 and the non-porous layer 140 (an interface between the porous layer 130 and the first non-porous layer 141 in the example of FIG. 2.)

By this arrangement, it is possible to coat the resin-based coating material 150 on the porous layer 130 after the porous layer 130 is connected to the non-porous layer 140. If the channel 160 is formed in an upper surface of the first non-porous layer 141, there is a possibility that the channel 160 will communicate with the open pores 130*a* of the porous layer 130. In this case, the channel 160 may be obstructed by the resin-based coating material 150 that has entered the open pores 130*a*. In the present embodiment, the channel 160 is formed at a position remote from a connection between the porous layer 130 and the non-porous layer 140. Therefore, it is possible to prevent the resin-based coating material 150 in the open pores 130*a* from entering the channel 160.

A specific position of the channel 160 is not limited to the position shown in FIG. 2, as long as the channel 160 is formed at a position remote from a connection between the porous layer 130 and the non-porous layer 140. For example, the channel 160 may be formed so as to have a downward opening that is open at a lower surface of the first non-porous layer 141. In this case also, it is possible to prevent the resin-based coating material 150 that has entered the open pores 130*a* from entering the channel 160, since a bottom surface of the channel 160 is located remotely from the lower surface 135 of the porous layer 130.

If a depth of impregnation of the porous layer 130 with the resin-based coating material 150 is appropriately controlled, the channel 160 having a downward opening may be formed in the lower surface 135 of the porous layer 130.

In the present embodiment, however, the channel 160 may not necessarily be formed in the polishing table 110.

Figure 3:
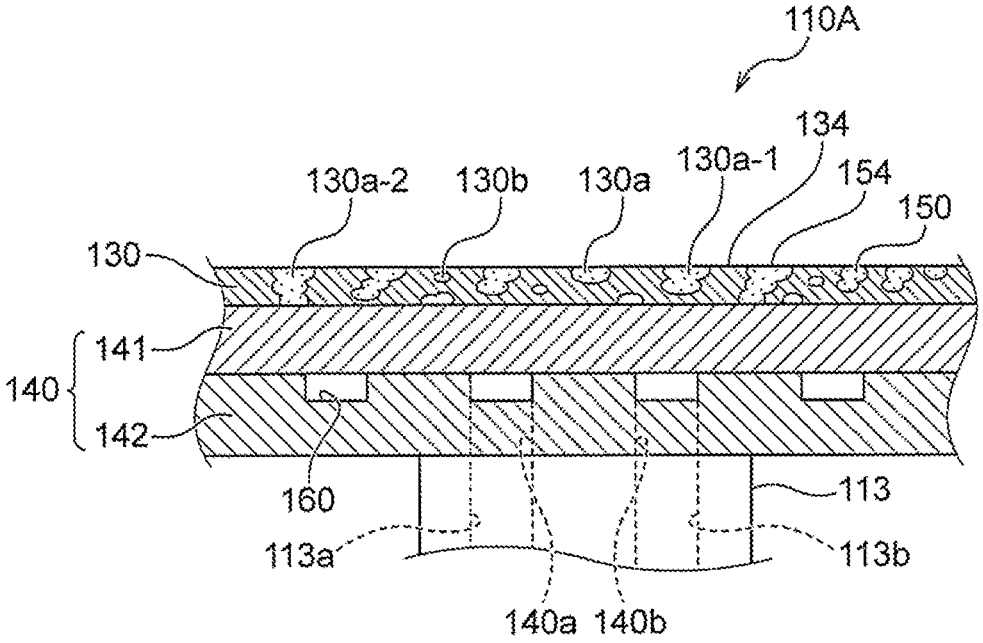
FIG. 3 schematically illustrates a section of a polishing table according to another embodiment of the present invention.
Figure 4A:
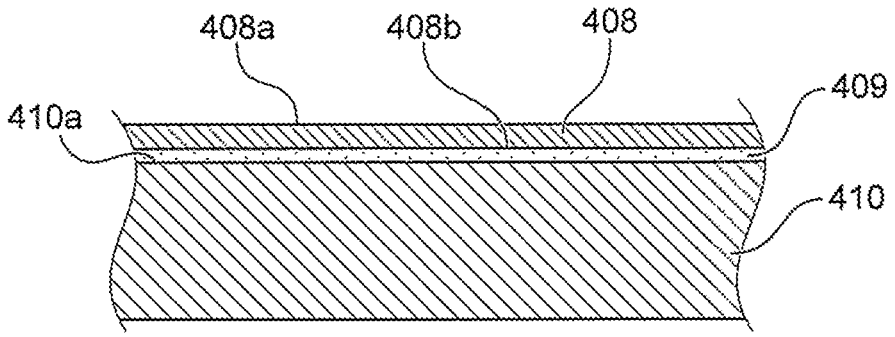
FIG. 4A shows an example of a conventional technique.
Figure 4B:
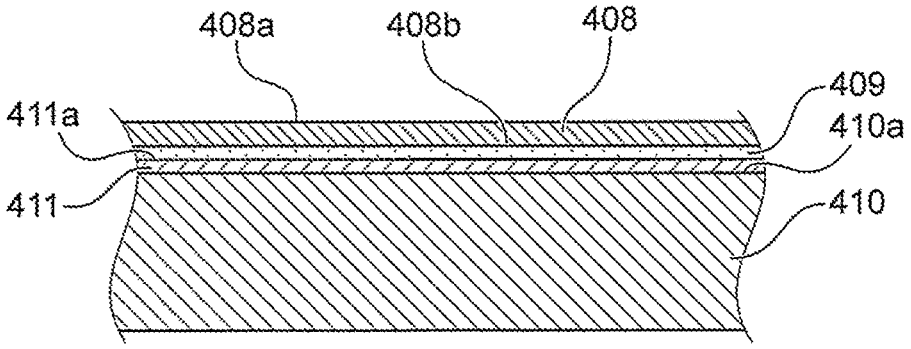
FIG. 4B shows another example of a conventional technique.

In the embodiment shown in FIG. 2, the resin-based coating material 150 is disposed so as to cover the entire upper surface 134 of the porous layer 130. In another embodiment, however, the resin-based coating material 150 may be disposed only in the open pores 130*a*, as shown in FIG. 3. In a polishing table 110A of FIG. 3, the upper surface 134 of the porous layer 130 is exposed outside the open pores 130*a* (in other words, the resin-based coating material 150 does not exist outside the open pores 130*a*.) Therefore, in the embodiment of FIG. 3, a support surface of the polishing table 110A is formed by the exposed surface of the upper surface 134 of the porous layer 130 outside the open pores 130*a* and the upper surface 154 of the resin-based coating material 150 in the open pores 130*a*. In this case also, due to the presence of a surface area for adhesion between the resin-based coating material 150 and the porous layer 130 within the open pores 130*a*, it is possible to prevent the resin-based coating material 150 from being detached from the porous layer 130 when a polishing pad is peeled off from the polishing table 110A. Accordingly, differently from conventional techniques, there is no need to machine a hard surface of a polishing table to a desired surface roughness. Further, as compared to machining, there is no risk of significantly lowering a flatness of a support surface of a polishing table for increasing a surface area for adhesion.

A support surface of the polishing table 110A shown in FIG. 3 may be formed by impregnating the upper surface 134 of the porous layer 130 with the resin-based coating material 150 according to any of various methods such as those stated above, followed by lapping (in other words, polishing) the upper surface 154 of the resin-based coating material 150 and the upper surface 134 of the porous layer 130. Thus, a high flatness of a support surface of the polishing table 110A can be obtained. Further, a primary function of the resin-based coating material 150, namely, enabling easy detachment of the polishing pad 108 from the polishing table 110A, can be maintained by the upper surface 154 of the resin-based coating material 150 in the open pores 130*a*.

Although the embodiments of the present invention have been described above based on some examples, the described embodiments are for the purpose of facilitating the understanding of the present invention and are not intended to limit the present invention. The present invention may be modified and improved without departing from the spirit thereof, and the invention includes equivalents thereof. In addition, the elements described in the claims and the specification can be arbitrarily combined or omitted within a range in which the above-mentioned problems are at least partially solved, or within a range in which at least a part of the advantages is achieved.

This application claims priority under the Paris Convention to Japanese Patent Application No. 2017-111605 filed on Jun. 6, 2017. The entire disclosure of Japanese Patent Application No. 2017-111605 filed on Jun. 6, 2017 including specification, claims, drawings and summary is incorporated herein by reference in its entirety. The entire disclosure of Japanese Patent Public Disclosure No. 2008-238375 (Patent Document 1) and Japanese Patent Public Disclosure No. 2014-176950 (Patent Document 2) each including specification, claims, drawings and summary is incorporated herein by reference in its entirety.

The present invention includes the following:

1. A polishing table having a support surface configured to support a polishing pad, the polishing pad being adapted to be used for polishing a substrate,
   the polishing table comprising:
   a stacked body comprising a stack of a porous layer and a non-porous layer, the porous layer including open pores formed in a surface thereof disposed to face a polishing pad; and
   a resin-based coating material disposed in the open pores so as to form at least a part of the support surface of the polishing table.
2. A polishing table according to item 1 above, wherein the resin-based coating material is disposed such that the surface of the porous layer disposed to face the polishing pad is entirely covered by the resin-based coating material.
3. A polishing table according to item 1 above, wherein the surface of the porous layer disposed to face the polishing pad is exposed outside the open pores, and the support surface of the polishing table is formed by the exposed surface of the porous layer and the resin-based coating material in the open pores.
4. A polishing table according to any one of items 1 to 3 above, wherein the porous layer comprises a ceramic material.
5. A polishing table according to any one of items 1 to 4 above, wherein the non-porous layer includes a flow passage formed therein, which allows a cooling fluid to flow through the polishing table, the flow passage being formed in a position remote from a connection between the porous layer and the non-porous layer.
6. A polishing apparatus configured to polish a substrate, the polishing apparatus comprising a polishing table according to any one of items 1 to 5 above.

INDUSTRIAL APPLICABILITY

The present invention is widely applicable to a polishing table for polishing a substrate and a polishing apparatus comprising a polishing table.

LIST OF REFERENCE SIGNS

100 polishing apparatus
102 substrate
108 polishing pad
110, 110A polishing table
112 first electric motor
113 rotary shaft
113*a* supply passage
113*b* discharge passage
116 top ring
118 second electric motor
120 slurry line
122 dresser disk
124 dresser unit
130 porous layer
130*a* open pore
130*a*-1 interconnected pores
130*a*-2 through pore
130*b* closed pore
134 porous layer upper surface
135 porous layer lower surface
140 non-porous layer
140*a*, 140*b* through passage
141 first non-porous layer
142 second non-porous layer
150 resin-based coating material
154 resin-based coating material upper surface
160 channel
408 polishing pad

408*a* upper surface
408*b* rear surface
409 adhesive layer
410 polishing table
410*a* polishing table upper surface
411 coating layer
411*a* coating layer upper surface

What is claimed is:

1. A polishing table for a polishing apparatus configured to polish a substrate, having a support surface configured to support a polishing pad through a layer of adhesive preliminarily provided on said polishing pad, said polishing pad being adapted to be used for polishing a substrate, said polishing table comprising:

a stacked body comprising a stack of a porous layer and a non-porous layer, said porous layer including open pores that are open at a surface thereof disposed to face a polishing pad; and a resin-based coating material provided between said porous layer and said layer of adhesive, such that said resin-based coating material adheres to said porous layer at least within said open pores and forms at least a part of said support surface of said polishing table, wherein said porous layer comprises a ceramic material.

2. The polishing table according to claim 1, wherein said resin-based coating material is disposed such that said surface of the porous layer disposed to face the polishing pad is entirely covered by said resin-based coating material.

3. The polishing table according to claim 1, wherein said resin-based coating material is disposed only in said open pores, and said support surface of the polishing table is formed by said surface of the porous layer outside said open pores and said resin-based coating material disposed in said open pores.

4. The polishing table according to claim 1, wherein said non-porous layer includes a flow passage formed therein, which allows a cooling fluid to flow through the polishing table, said flow passage being formed in a position remote from a connection between said porous layer and said non-porous layer.

5. The polishing table according to claim 2, wherein said non-porous layer includes a flow passage formed therein, which allows a cooling fluid to flow through the polishing table, said flow passage being formed in a position remote from a connection between said porous layer and said non-porous layer.

6. The polishing table according to claim 3, wherein said non-porous layer includes a flow passage formed therein, which allows a cooling fluid to flow through the polishing table, said flow passage being formed in a position remote from a connection between said porous layer and said non-porous layer.

* * * * *